US006171168B1

(12) United States Patent
Jessop

(10) Patent No.: US 6,171,168 B1
(45) Date of Patent: Jan. 9, 2001

(54) SOUND AND ACTION KEY WITH RECOGNITION CAPABILITIES

(75) Inventor: Richard V. Jessop, London (GB)

(73) Assignee: Carterbench Product Development Limited(GB)

( * ) Notice: Under 35 U.S.C. 154(b), the term of this patent shall be extended for 0 days.

(21) Appl. No.: 09/379,395

(22) Filed: Aug. 23, 1999

Related U.S. Application Data

(60) Provisional application No. 60/097,607, filed on Aug. 24, 1998.

(51) Int. Cl.[7] ..... A63H 3/28
(52) U.S. Cl. ..... 446/297; 446/298; 446/397
(58) Field of Search ..... 446/77, 81, 268, 446/297, 298, 302, 397, 404, 489

(56) References Cited

U.S. PATENT DOCUMENTS

| | | | | |
|---|---|---|---|---|
| 3,343,281 | | 9/1967 | Greer, Jr. et al. | 35/35 |
| 4,348,191 | | 9/1982 | Lipsitz et al. | 434/308 |
| 4,392,053 | | 7/1983 | Bockholt | 235/472 |
| 4,622,771 | | 11/1986 | Spengler | 40/547 |
| 4,729,564 | | 3/1988 | Kuna et al. | 273/1 E |
| 4,820,233 | | 4/1989 | Weiner | 446/303 |
| 4,846,693 | * | 7/1989 | Baer | 446/298 |
| 4,904,988 | | 2/1990 | Nesbit et al. | 340/628 |
| 4,923,428 | | 5/1990 | Curran | 446/175 |
| 5,037,345 | | 8/1991 | Nakayama | 446/297 |
| 5,073,140 | * | 12/1991 | Lebensfeld et al. | 446/268 |
| 5,092,810 | * | 3/1992 | Kwan et al. | 446/268 |
| 5,314,336 | | 5/1994 | Diamond et al. | 434/169 |
| 5,443,388 | * | 8/1995 | Jurmain et al. | 446/297 |
| 5,607,336 | | 3/1997 | Lebensfeld et al. | 446/297 |
| 5,636,994 | * | 6/1997 | Tong | 446/298 |
| 5,648,753 | | 7/1997 | Martin | 340/324.1 |
| 5,864,288 | * | 1/1999 | Hogan | 446/297 |

* cited by examiner

*Primary Examiner*—Sam Rimell
(74) *Attorney, Agent, or Firm*—Ostrager Chong & Flaherty LLP

(57) ABSTRACT

An electronic device or module which, when in contact with or remote from an object, recognizes the object and plays sounds, creates movement in the object, or turns on lights, or activates other electrical circuits appropriate to the object's identity, environment and/or movement of any parts of that object. The object need not contain any electronics or a power source and need not be connected to the device electronically.

31 Claims, 9 Drawing Sheets

14.5v
SOUND KEY POWER SWITCH
SPEAKER
8.2 ohms
SOUND KEY SWITCH COMMON
220n
Vccd
Vcca
Veed
Veea
SP+
SP-
AUX IN
ANA IN
ANA OUT
MIC RET
MIC
AGC
ISD25xx
A0
A1
A2
A3
A4
A5
A6
A7
A8
A9
CE
PD
P/R
EOM
OUF
XCLK
0V
47K
47K
OA
OA
OB
OB
Vdd
RCTCA
CTCA
I1A
I2A
CDA
RCTCB
CTCB
I1B
I2B
CDB
Vee
4K
10n
100K
4.7µ
47K
SOUND KEY INPUTS
A7
A8
MOVEMENT SWITCH FIG. 7A
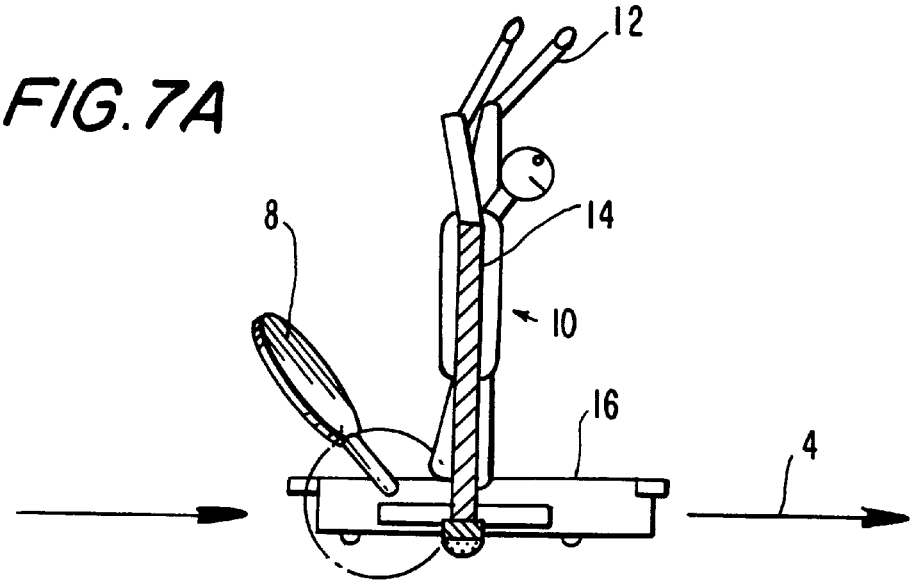
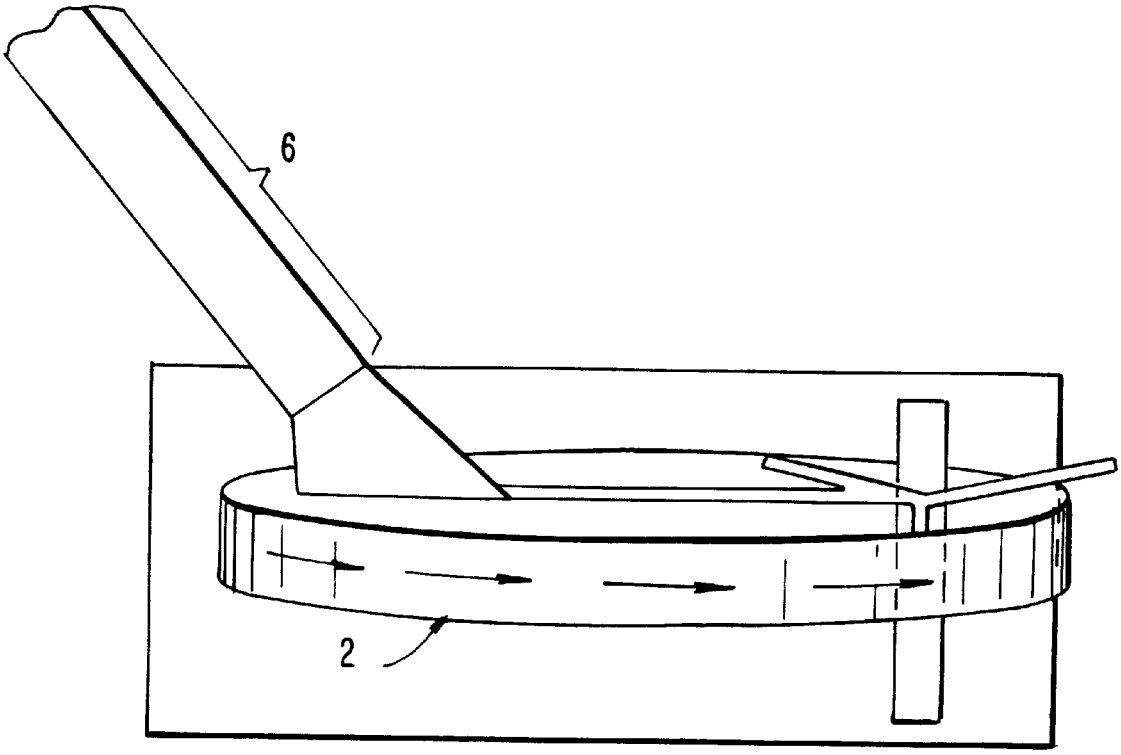
FIG. 7B

SOUND AND ACTION KEY WITH RECOGNITION CAPABILITIES

This application claims priority from the earlier filed U.S. Provisional Application Ser. No. 60/097,607, filed Aug. 24, 1998.

FIELD OF THE INVENTION

This invention generally relates to an apparatus for interfacing with and recognizing an object. More particularly, upon recognition, the apparatus generates sounds, movements or lights appropriate to the object, the object's movement or its environment.

BACKGROUND OF THE INVENTION

In the toy industry, there are many occasions where it is highly desirable for an object to incorporate electronics which enhance that object's functionality, for example, by making sounds, turning on lights or moving the object's movable elements. Adding such functionality to a toy, however, adds significant cost, sometimes to the extent that of making such a toy not commercially viable.

It is known that physical objects may be encoded in some way, for example, by mechanical, electronic, optical, other means or a combination thereof, to cause one or more sound messages relating to that item to be generated when the encoded object is placed in contact with or near a means for reading the code. See U.S. Pat. Nos. 5,648,753, 4,348,191, 5,314,436, 4,729,564, 3,343,281, 4,392,053, 4,820,233, 5,607,336, and 4,923,428. Such devices are also known to be quite costly and, therefore, not commercially viable in the toy industry.

It is therefore an object of this invention to provide a simple inexpensive object, such as a toy, with a means for generating sounds, signals and/or movements appropriate to the objects identity or environment without the need for expensive electronic components being incorporated into the object.

SUMMARY OF THE INVENTION

In the present invention, these purposes, as well as others which will be apparent, are .achieved generally by providing a single device for controlling the sounds, movements, actions and lights of a plurality of inexpensive objects. More particularly, a device for providing sound and/or movement capabilities to a plurality of objects comprises an object detection means for detecting an identity of each of the objects and producing an identity signal, a movement detection means for detecting a plurality of movements by any of the objects and producing a movement signal, a sound storage means for storing one or a plurality of sounds associated with any of the objects and any of the movements, a sound playback means for receiving the identity signal and/or the movement signal from the object and movement detection means and for accessing and generating a selected sound in the sound storage means responsive to the identity signal and/or the movement signal, and a speaker means for amplifying and audibly emitting the selected sound.

The identity signal and the movement signal are produced when the device is in contact with, or in a position remote to, the objects.

The object detection means of the device comprises an object sensor means for sensing an identity code associated with each of the objects. The identity code and the sensor means may be mechanical, electrical, infrared, radio frequency, sound, optical, magnetic, electromagnetic, pneumatic, vibration, capacitive or inductive.

The movement detection means of the device comprises a movement sensor means for sensing a movement code associated with each of the movements. The movement sensor means and the movement code may be mechanical, electrical, infra-red, radio frequency, sound, optical, magnetic, pneumatic, vibration, capacitive or inductive.

The sound storage means of the device may be an integrated circuit having either playback-only, or alternatively record and playback features. The playback features may be activated automatically or manually.

The device may include motor means for providing a drive force to one or more movable element(s) on any of the objects. The drive force is generated in response to the identity signal and/or movement signal.

The device may include means to detect one or more secondary objects and the appropriate secondary identities and then produce secondary identity signals. Such a device may also produce a secondary identity signal when the object comes into contact with at least one secondary object.

Other objects, features and advantages of the present invention will be apparent when the detailed description of the preferred embodiments of the invention are considered in conjunction with the drawings which should be construed in an illustrative and not limiting sense as follows:

BRIEF DESCRIPTION OF THE DRAWINGS

FIG. 7A is an illustration of a further mechanical means by which an object's movement may be conveyed to the Key.

FIG. 7B is an enlarged view of the circled area in FIG. 7A.

DETAILED DESCRIPTION OF THE PREFERRED EMBODIMENTS

The present invention relates to a Key which provides objects with electronic functionality without adding significantly to the objects, per unit cost. The Key may be in various sizes or shapes (i.e., it need not resemble a key at all) and may be connected to almost any object adapted for that purpose. The object with which the Key interfaces with need not necessarily have any electronic or metallic parts or a power source.

In one embodiment of the invention, Keys that are inserted into, or otherwise physically attached to, an object will recognize the identity of the object and will play out one or more appropriate sound messages in response to the recognition, or as a result of the detection of any movement of the object or a moveable element of the object, or any combination of these variables.

The Key comprises a sensor means, a sound producing means, a power supply and a processor or integrated circuit, which is programmed to recognize a series of objects.

Figure 1:
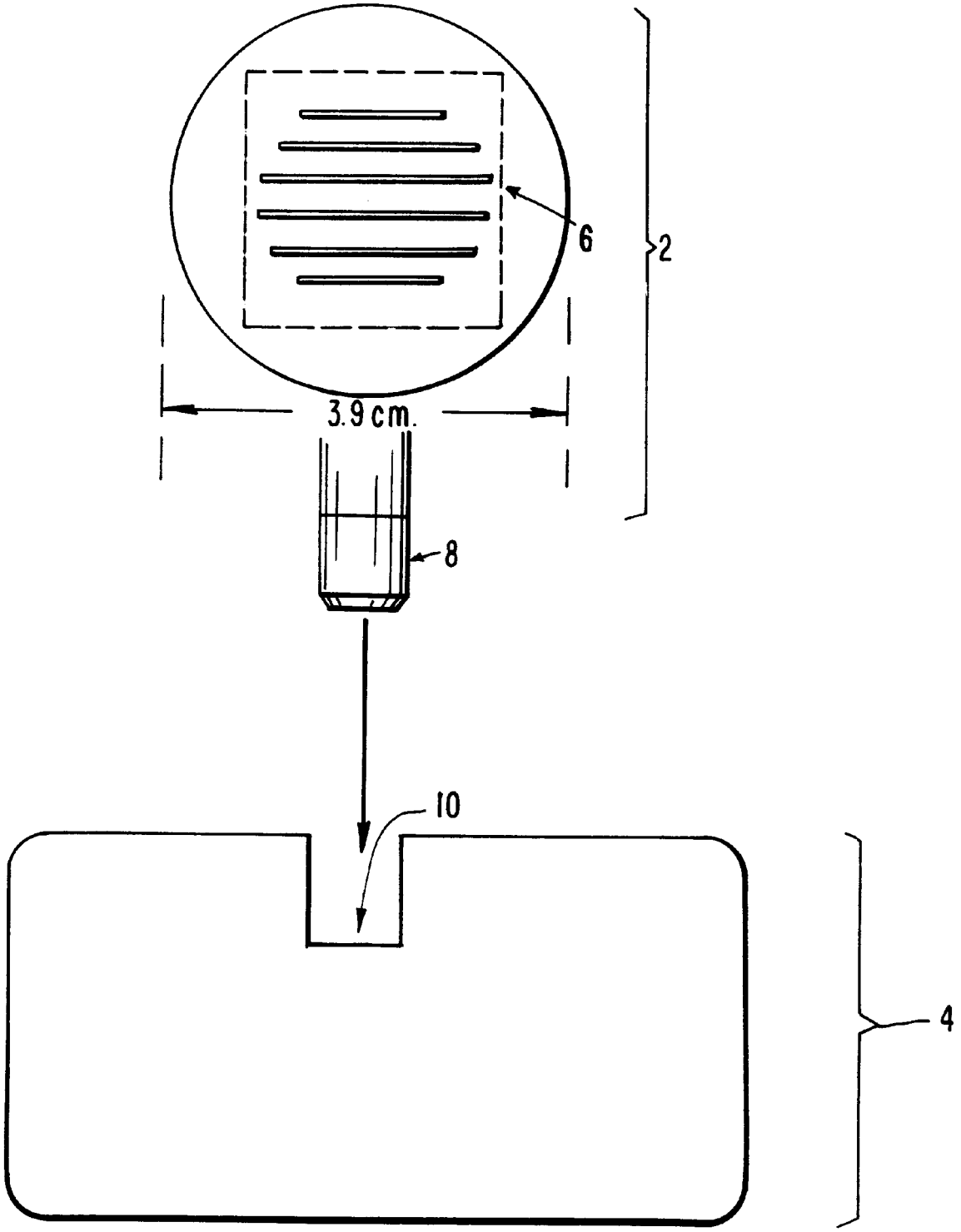
FIG. 1 is an illustration of one embodiment of the invention showing the Key's insertion into an object.

One possible configuration of the Key/object interface is shown in FIG. 1. A Key 2 and an object into which it is inserted 4. The Key includes a printed circuit board, a sound integrated chip and batteries (all not shown) and a speaker 6. The Key contacts the Object with end 8 when inserted into the object at 10.

A user who has collected a number of different objects which are compatible with the Key may add electronic functions to all of the objects in the collection by purchasing one Key.

In addition, a Key may be prompted to play a sound corresponding to an object which it has recognized when a switch, or series of switches, on either the object or the Key is activated. In this situation, only the recognition of the object and the activation of -the switch is required for the Key to play a particular sound.

The Key may include a memory Integrated chip ("IC") containing all of the sound messages for various objects, even for objects not yet purchased, and it may also include a recording/playback IC and a microphone. A user may record messages on a Key so equipped and the Key will replay the recordings when inserted into the appropriate object, or when the object or one or more particular element (s) on the object is moved.

The Key, therefore, may recognize the object into which it is inserted, as well as particular movements of the object or parts of the object, and play prerecorded or user recorded sounds.

The Key may incorporate a means of supplying mechanical energy to move one or more movable components of the object into which the Key has been inserted.

The force provided by the Key could be an individual motion or a complex series of timed motions of any moveable elements on the object.

Alternatively, the object may be moved manually and the Key may play appropriate sounds in sync with the object's movements. Sounds may be varied according to the speed or direction or other variables of the object's movement.

The Key may combine all of the above features or any combination thereof. The same chip containing the sound messages may also contain the program controlling the movement.

The Key may be equipped so that the user may manually move the object, and those movements may be recorded by means of a mechanical linkage into a memory IC on the Key. The recorded information may then be used to repeat the sequence recorded by the Key.

In addition, the Key may detect the attachment or removal of an accessory from the object, and preprogrammed or recorded messages may be played when attachment or removal is detected. The Key may monitor several movable or changeable elements simultaneously.

Similarly, the timing of such events may be recorded by the Key if it equipped with a microprocessor or other means of measuring or recording time, movement, such as with a gravity switch, or other variables.

Additional or new sounds and/or programs may be recorded onto the Key's memory from a remote source. This allows, for example, the Key to be updated to work with objects produced after the Key's purchase. Similarly, the Key may be reprogrammed to play prerecorded messages in different languages for different commercial markets.

Furthermore, Keys may incorporate electronic components to enable them to recognize the presence of other Keys within a certain range.

This feature will allow a Key to recognize the object to which the second Key is attached and to then play a sound, generate a movement or send a signal which is appropriate to the relationship between the objects.

In another embodiment of the invention, one or more objects are equipped with means of generating signals which are identifiable by a Key at a remote location. More than one signal may be generated so that individual objects, and their individual actions, may be identified by the Key.

Figure 2:
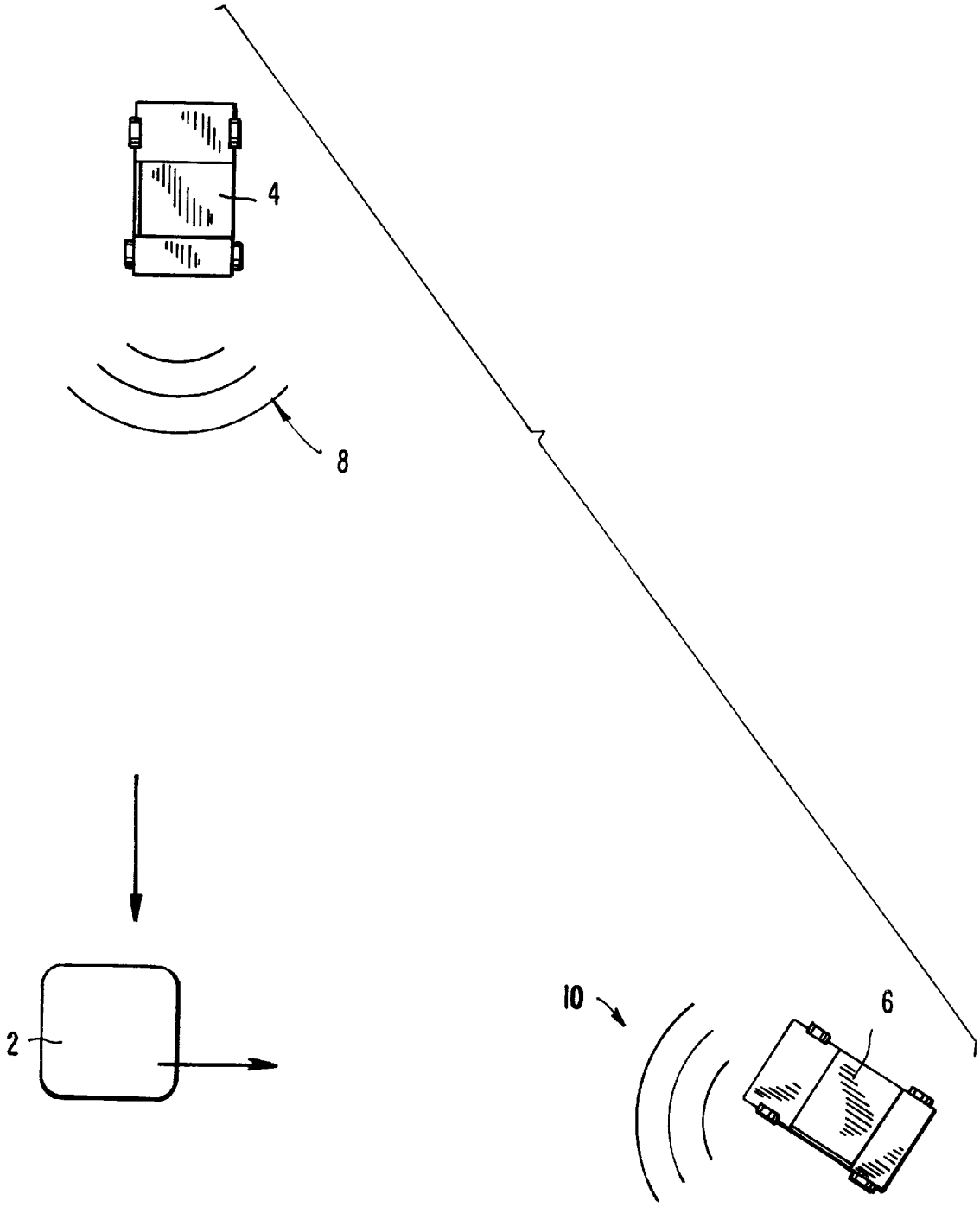
FIG. 2 is an illustration showing how a Key may recognize two remote objects.

This type of system is represented in FIG. 2, which shows a Key 2 placed remotely from a first object 4 and a second object 6. First object 4 produces a sound, vibration or other coded signal type 8 which differs from the second object's code 10. This allows the Key 2 to recognize multiple objects simultaneously. Relative speed, direction, and other information may be transmitted also.

This embodiment may include any system wherein coded or distinctive signals of any type are mechanically generated (or the power to emit those signals is mechanically generated) by a device without a power source and transmitted to a remote receiver.

In another embodiment of the invention, the Key may be in the form of a platform or stage upon which objects are placed. Alternatively, the Key may be attached to the platform or may be connected to an object placed upon a platform. In either case, the Key may coordinate sounds and/or movements appropriate to the objects and their movements, moveable elements or attachments as well as changing environments created on the platform.

This system allows objects on the platform to "recognize" each other and "act" appropriately, taking into consideration the relationship between the various objects and the particular scenario in which the objects find themselves.

This is an improvement over the prior art which simply plays an appropriate sound when a given object is placed upon the platform. In this invention the identity of the object, the location of its placement, the identities of other objects and the changeable environment on the platform will alter the sounds played by the Key.

Figure 3:
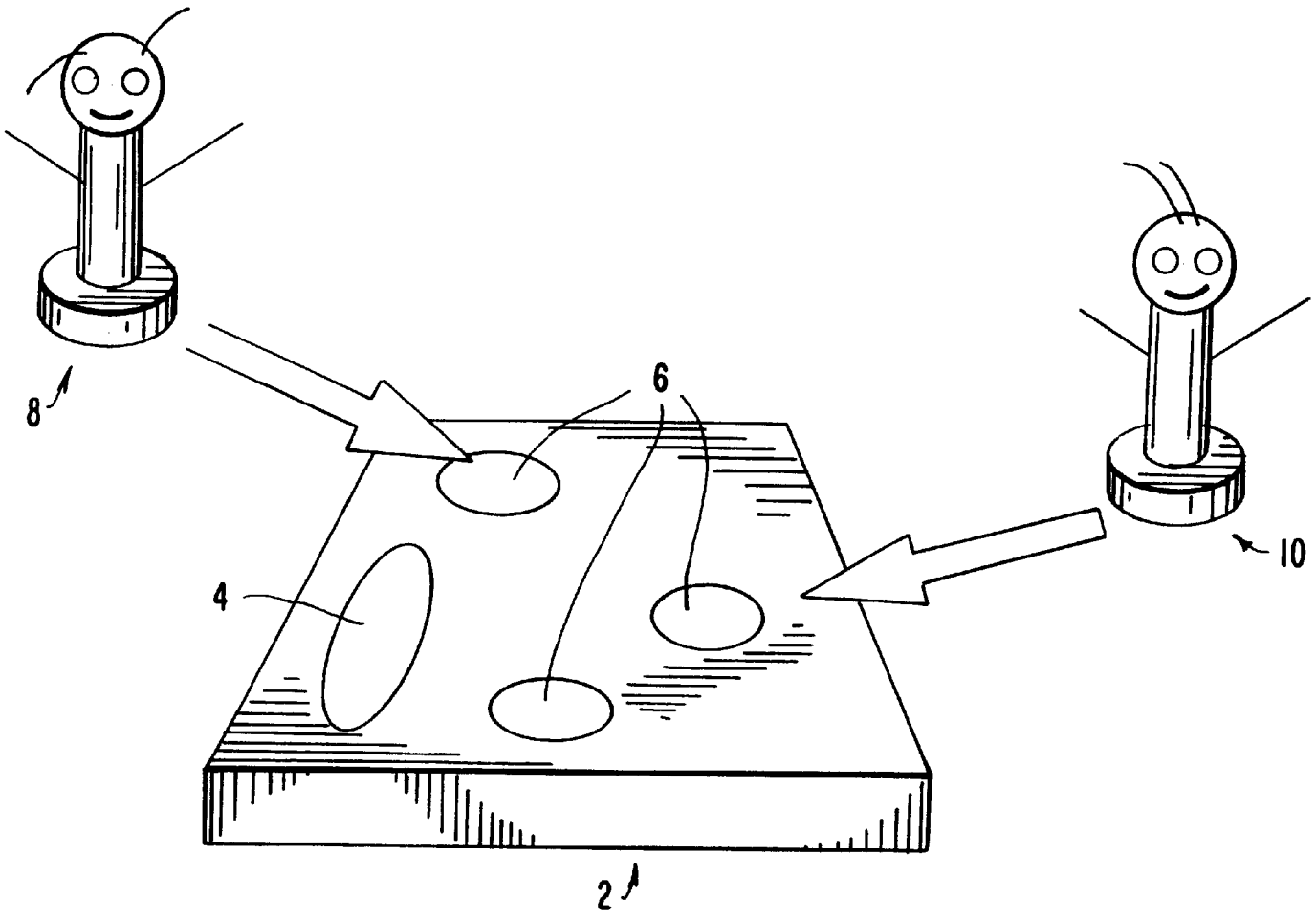
FIG. 3 is an illustration showing another embodiment of the invention where the Key is in the form of a surface upon which objects may be placed and recognized.

One example of this type of configuration is seen in FIG. 3 which shows the Key 2 in the form of a platform. The Key 2 has a speaker 4 and three sensors 6 on its surface. A first figurine 8 and a second figurine 10 may be placed upon any of the sensors 6 to elicit different sounds. Sounds vary depending on which sensor is contacted by a given figurine, or in which order different figurines "arrived" or "departed" from the platform. Since the Key may detect both figurines and their relative location to each other, the placement of both figurines on various combinations of sensors may, for example, elicit different sounds programmed to fit the scenario.

Thus, in the drawing below, we have a base unit containing sensors on its upper side capable of reading the respective ID codes on the bases of figurines Mr. Black and Mr. White. Within the base unit is a power source, sound storage and playback chip, speaker and microprocessor, or alternative hardware means of recognizing which figurines are in which locations, and of causing appropriate sound messages to be played out a a consequence.

Figure 4A:
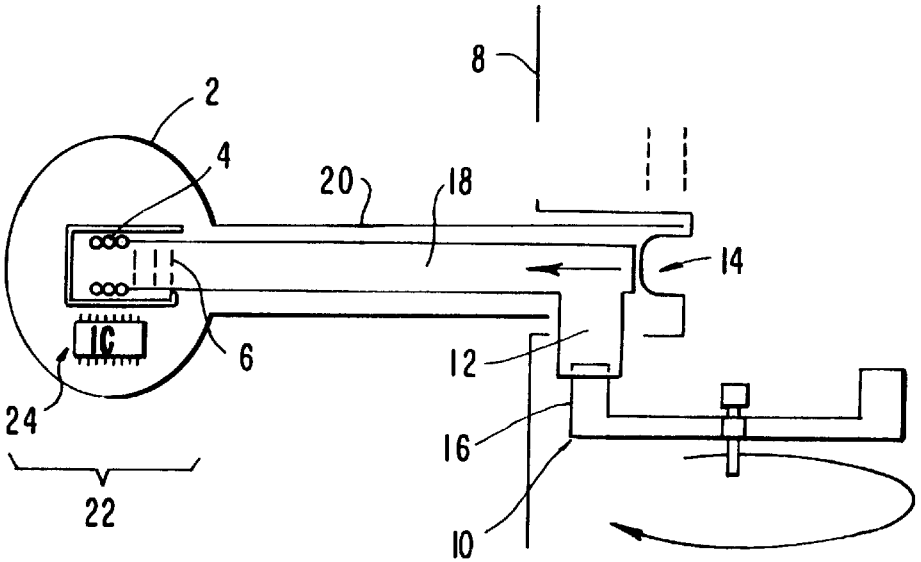
FIGS. 4A and 4B are illustrations showing a further embodiment of the Key, and mechanical means by which the Key may recognize the identity and movement of the object.
Figure 4B:
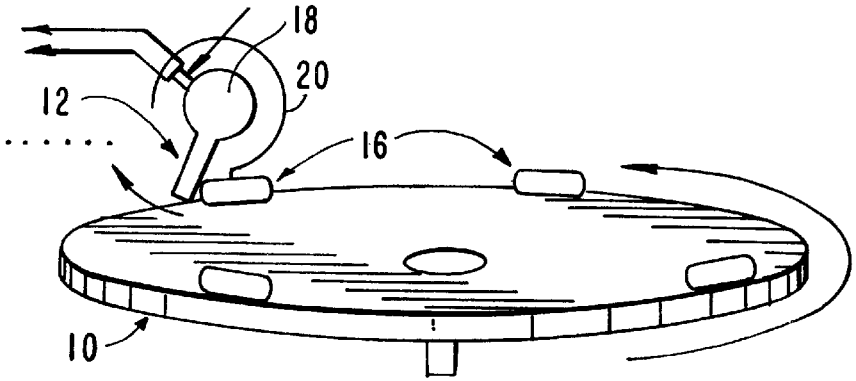

FIG. 4A and 4B show one way in which a Key might recognize the object into which it is inserted and, further, recognize motion of at least one element of the object.

FIG. 4A shows a Key 2 inserted into an object 8. When inserted, control shaft 18 slides within the outer shaft 20 in a direction towards the Key's body 22 against a spring 4 because of the control shaft's contact with a contact point 14 in the object during or after the Key's insertion into the object. The end of the control shaft contacts electronic elements at 6 thereby causing the Key's electronics 24 to elicit a sound. The distance that the control shaft 18 moves is determined by the size of the contact point at 14. Variation in the dimensions of the contact point allows each. object to be identified FIG. 4B shows how a wheel 10 inside the object may be used to communicate the objects motion to the Key. The wheel 10 is mechanically linked to a second wheel on the outside of the object which rotates when the object moves (not shown). When the wheel 10 rotates, raised sections 16 on the wheel contact the control shaft 18 at 12 thereby causing the control shaft to rotate slightly. The rotation causes the control shaft 18 to contact different electronic elements at. 6 (FIG. 4A) thereby causing the Key's electronics 24 to elicit a second sound.

Figure 5:
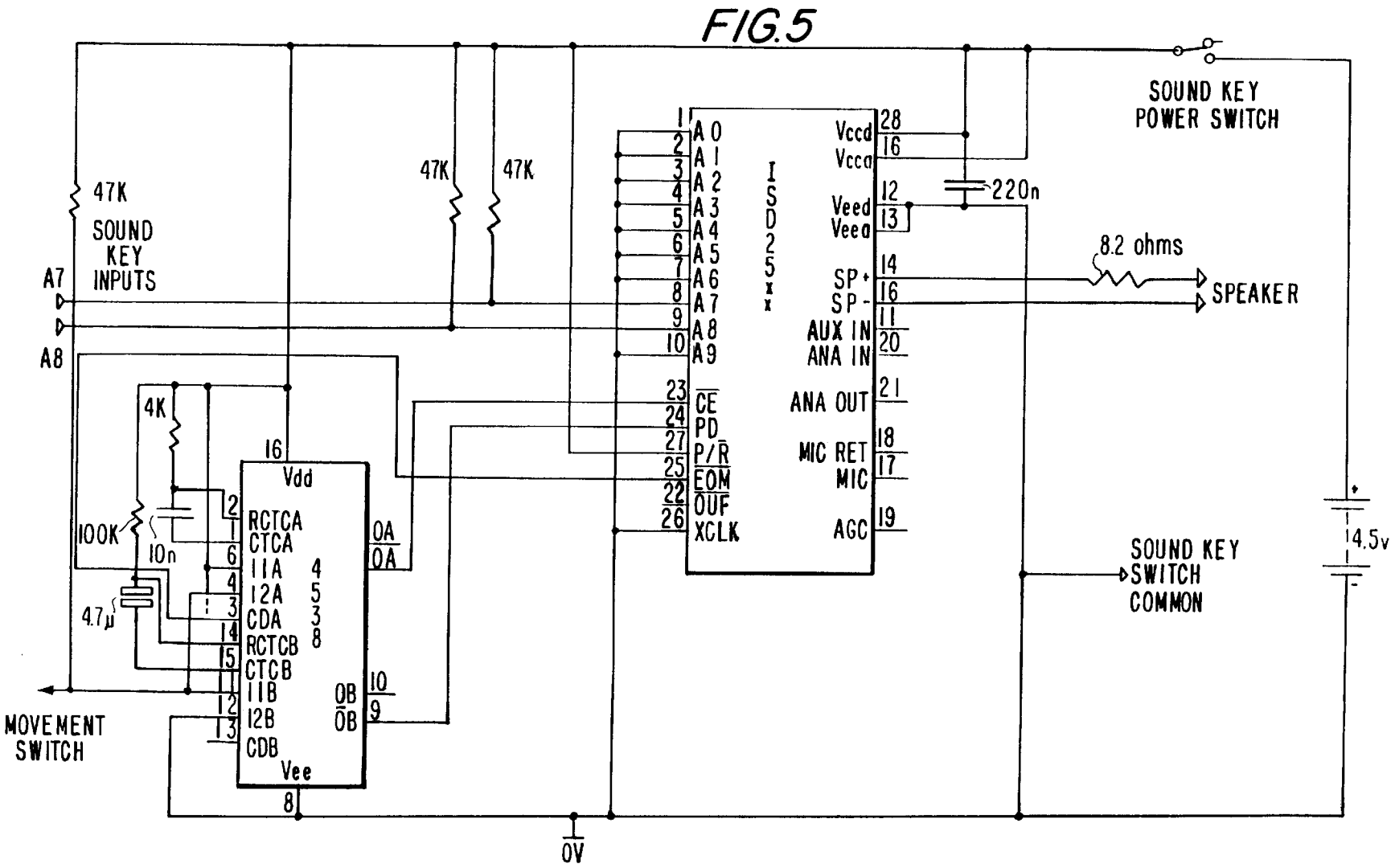
FIG. 5 is a circuit diagram of an integrated circuit which may be incorporated into the Key.

FIG. 5 is a circuit diagram of an integrated chip of the type that may be used to control the Key's electronic elements.

Figure 6:
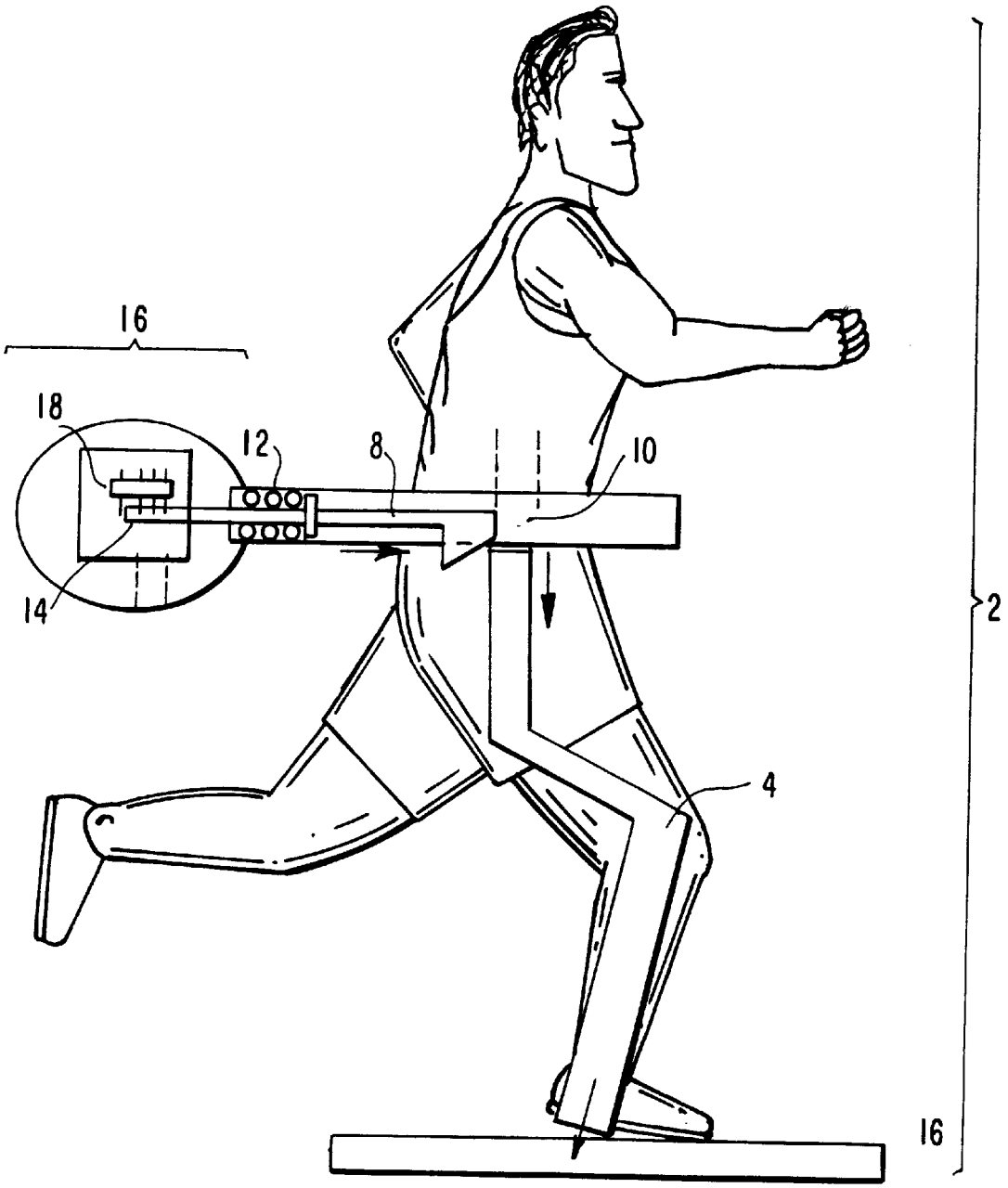
FIG. 6 is an illustration of a object figurine containing mechanical means by which information about the object's disconnection with a surface may be conveyed to the Key.

FIG. 6 shows how the Key would detect an object being lifted off of a surface. A figurine 2, containing an element 4 which moves downward when the figurine is lifted off of a surface 6. When the element 4 moves downward, spring loaded element 3 moves into the void 10 left by the evacuated element under the force created by a spring 12. Section 14 of the spring loaded element remains in the portion of the Key containing the electronic components 16. The movement of section 14 causes it to move across contacts 18, thereby causing the Key to play an appropriate sound.

FIGS. 7A and 7B show another embodiment of a Key which not only recognizes the object with which it is in physical contact but also is equipped with a sensor means to determine the status of one or more movable items on the object.

In FIGS. 7A and 7B Rotating element 2 rotates when the object 4 moves. The detection system 6 monitors the movement of the rotating element 2 by optical means. The Key 8 receives this information from the detection system 6 and plays an appropriate sound which may vary with the direction or speed of the object. The figurine 10 has moveable arms 12 which move when driven mechanically by a shaft 14 which travels to the base 16 and receives mechanical energy from the rotating element 2.

Many other mechanical recognition means would be suitable. For instance, electronic means may be employed and electric circuits on the object may be closed by metallic elements on the object. Various combinations of open and closed circuits will allow recognition of each individual object.

Optical means may be used to recognize the object and detect movement of parts of the object without a direct connection. For example, movement of an element on the object may be detected by a sensor and the Key will play an appropriate sound message. This type of Key does not require an electrical or physical connection to the figurine arm.

Magnetic means may also be employed. For example, Hall-effect sensors may be incorporated into the end of the Key's shaft, and the movement of a magnetized element linked to an object's moveable element in front of the Hall-effect switch would permit recognition of that movement by the control electronics. Similarly, a series of such switch means may be used to identify the object. Magnetic means may also be used by the Key to cause the object to move. The Key's electronics may cause an electromagnetic field to be created which acts, for example, like the coil in a solenoid, thereby attracting or repelling movable item(s) within the object which incorporate ferrite material. Thus, the Key uses magnetism to move parts of the object. Other sensing or movement techniques, for example, capacitive, inductive, electromagnetic or other means are also feasible.

Mechanical means for communicating information to the Key has the advantage of avoiding the use of metallic materials in the objects themselves. For example, a Key, with various protrusions (the Key may look similar to a typical key) may have a number of protrusions at the end of a shaft. Such protrusions may be mechanically linked to different tubes within the shaft of the Key, like a telescopic aerial. When the Key is turned inside different objects, different combinations of the protrusions are forced backwards by impacting with obstacles within the object as the turning takes place.

Mechanical power may be delivered to the object from the Key in many ways. An electric motor, a manually-powered motor/winder, memory metals, solenoids, spring-loaded means or other such power delivery devices in the Key may provide mechanical power to the object.

The Key may have one drive shaft driven by its on-board motor which may mechanically interface with a number of different cogs, for example, on-board the object the drive shaft may move backwards and forwards activated by a solenoid or memory metal so that it engaged different cogs on the object at different times. These cogs in turn may be mechanically linked to different movable items on the object. Alternatively, the Key will incorporate more than one drive shaft which runs within the casing of the Key which leads into the object.

An object may transmit information concerning its identity, movement(s) and location by many remote means. For example, the object may communicate movement of it's parts to the Key by use of a coded series of clicks or vibrations. The clicks may be caused by the movement of the object part and may be communicated to a piezo, microphone or the speaker acting as a microphone, in the Key. An appropriate sound message may be played by the Key in response to the clicks or vibrations.

Figure 8:
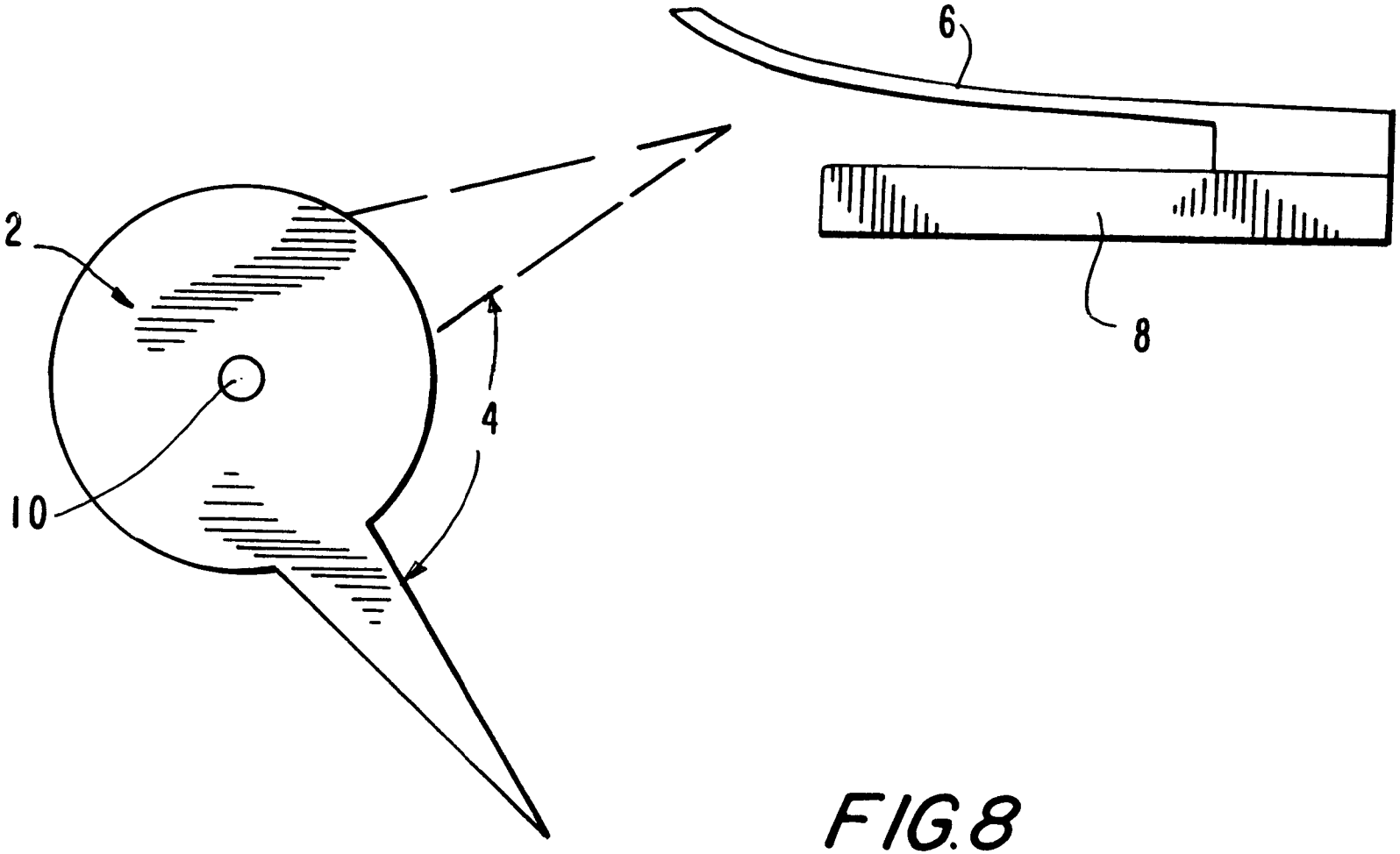
FIG. 8 is an illustration showing one manner by which an object may generate a coded sound signal with mechanical means.

FIG. 8 shows how an object night generate a coded sound signal mechanically. A cog 2 attached to the axle 10 on the object is connected to a wheel (not shown) so that the cog 2 rotates as the object moves. As. the cog 2 rotates, protruding elements 4 attached to the cog 2 strike a flexible member 6 which is fixedly attached to part of the object 8. The pattern of the signal created by the striking of the elements 4 against the member 6 will vary depending on the number of protruding elements and their placement on the axle. The rotational speed may also be detected by the Key because a more quickly rotating axle will repeat the clicking code more frequently.

The remote device is in this case equipped with a microphone or other sound/vibration detection means, and either a microprocessor or other hardware or software means of interpreting the received codes/pulses. If necessary, the remote device may separate the mechanically-generated or mechanical movement related signals from background noise. Techniques for such separation of filtering are well known.

The design described above may create an audible clicking sound of any frequency or an ultrasonic sound. One advantage of ultrasonic frequencies is that the electronic device reading the generated codes may thereby more easily separate the generated sound codes from extraneous environmental noise.

Another system for generating a code from an object containing no power source is by using piezo-electric, or piezo-ceramic, material. This material has, among other characteristics, two potentially useful functions: 1) When physical pressure—or vibration—is applied to piezo materials, they discharge an electrical potential, and 2) When an electrical potential is applied to the piezo material, it will change its shape and/or dimensions according to the electrical poling that has been applied to it in the manufacturing process.

These characteristics may be used to transform the energy generated by physical movement—e.g., hitting a piezo-electric transducer repeatedly—into electrical power, and then using that electrical power to enable the transmission of a signal to the Key.

Electrical energy may be used to power such devices as an LED—which would flash each time a cog passed or, for example, an radio transmission coil (with capacitor, etc., to send a radio signal a short distance) or a number of other devices which use different means to send a signal to the Key.

If each stroke of the hammer onto the piezo disc generates sufficient energy to power the particular signal transmission device, any encoding system used on the teeth of the cog will be relayed by the transmitting device. The Key may thereby determine the identity, or speed or other information, of the transmitting device. Optionally, if the electrical power generated is used to power the generation of a sound signal via the piezo, differences between different piezo elements (e.g., their respective resonant frequencies) could be used to As determine the particular object's identity.

Alternatively, if the electrical energy discharged by each impact on the piezo is insufficient to generate said signals, the discharged energy from the piezo may be temporarily stored in a capacitor, or similar energy storage device, by well known electrical design means, for example, a small number of transistors linked to the capacitor. When sufficient electrical power has been accumulated by the capacitor, it will discharge that charge to the transmitting device, for example, a tuned coil with a capacitor. A code could be added to the transmission by any number of well-established means using a minimal number of electrical components, or alternatively the discharge from the capacitor could be directed via a switch linked to the hammer (or cog) movement so that a short signal was sent by any suitable means every time a cog impacted on the hammer mechanism thereby passing the cog's encoding on to the remote sensing unit.

If desired, an ultrasonic signal may be transmitted. The piezo-electric transducer may be used to transmit the signal, where the electrical energy it generated, having been stored and sent back to it, and will cause it to vibrate at its resonant frequency, which may, for example, be an ultrasonic frequency, which could be relayed to, and received by, the Key.

There are many other arrangements that may be used for causing the piezo to generate an electrical current. A cam surface on the axle instead of a cog, for example, could squeeze the piezo disc. As an alternative to the piezo method of generating electrical charge, two or more magnets could be driven past a coil, thereby generating an electrical current, to perform the same electrical power-generating role as the piezo example above. Either of the two methods could alternatively be used to supply the electrical power to drive, for example, an integrated circuit on-board the object. Such an IC might, for example, be a sound playback IC, connected, optionally, to its own speaker means on-board and integral to, for example, a toy.

Figure 9A:
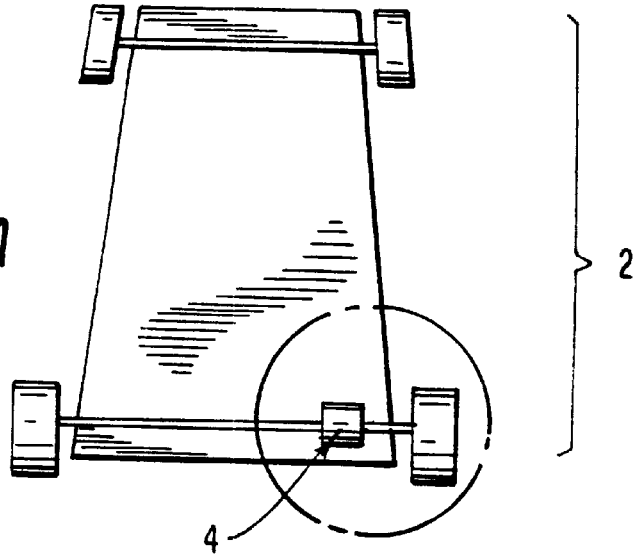
FIG. 9A is an illustration showing how a piezo disk may be incorporated into an object to create electrical energy and, thereby, facilitate recognition of the object by the Key.
Figure 9B:
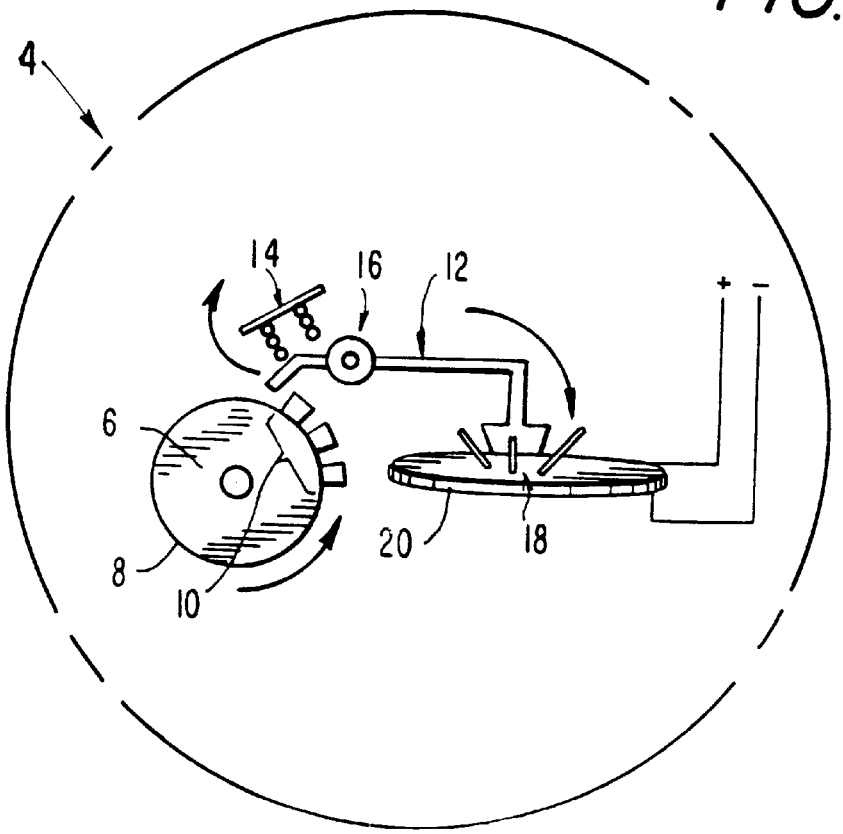
FIG. 9B is an enlarged view of the circled area in FIG. 9A.

FIGS. 9A and 9B show how a remote object may mechanically generate electrical power which may be used to transmit information to a remote Key.

In FIGS. 9A and 9B, a toy car 2 a piezo device 4 is placed near the toy's axle 6. A rotating cog 8 on the axle has a series of teeth 10 which strike a hammer 12 as the cog rotates. After each contact between a tooth 10 and the hammer 12 a spring 14 returns the hammer to its original position so that is may be impacted by the next tooth. When impacted, the hammer pivots at 16 and strikes a piezo-ceramic disk 20 at point 18. This impact creates electrical energy which may be used by the toy car 2 to communicate its identity or movement to the Key or to operate other electrical parts on the toy.

The Key will, by means of a microphone, piezo sensor or other suitable sensor means, receive the emitted sounds, vibrations or other signal types and will, with the aid of a microprocessor or solid state logic, and, using well-established techniques for identifying coded information amongst extraneous noise, filter out unwanted extraneous sounds and match the code or sound emitted with one which is stored in its memory, and with which one or more sound messages stored in an integral or associated sound storage facility are associated.

Thus, if the code for an object is "click-long space—click—short space-click-short space" the microprocessor, having recognized this series of clicks and spaces will refer to its memory and will determine that it should cause a particular sound message to be played out.

The microprocessor may be programmed to play a sound message faster or slower according to the speed at which the code is being generated, or it may play a number of different messages according to the repetition speed of the code which is controlled by the speed of the object. The noise-generating device on-board the object may also emit different sounds when the object changes direction and a microprocessor in the Key may initiate appropriate sound messages. Similar coding techniques will allow the Key to recognize movement by a particular element on an object when the elements movement causes a clicking, vibration or other signal.

In order to speed the recognition process so that the electronic device equipped with a sound IC may play out the appropriate sounds as soon as possible after the object is put into motion, the mechanical coding system used in association with the object, or element on the object, being moved may create many repeated cycles of the code in a short period of time.

In addition, the microprocessor may be equipped or associated with an analog-to-digital converter so that it may receive the analog signals from the noise generating device, digitize them, and then filter out unwanted noise to isolate the codes being generated. The signals may, optionally, be treated as digital signals.

The sound, vibration or other signal type characteristics of a particular movable device may be stored in a memory IC associated with the microprocessor so that the latter may search from amongst such stored noise characteristics memory files to seek to match inputs it is receiving from its environment.

Thus, for example, a moving object generating unique sound or vibration characteristics will be recognizable to a microprocessor match those sound patterns with the closest matching in its memory IC.

Thus, the object is not necessarily actually generating a code that has been preprogrammed. Instead, it may make a particular sound or pattern which enables the microprocessor to identify it by achieving the nearest match with stored information. Alternatively, the user may use an incorporated record/playback IC in the Key to provide the microprocessor with new samples of sounds made by different movable items, and may instruct the microprocessor which sound message(Es) should be played out by the microprocessor/speaker when a match is made.

Alternatively, the microprocessor may be programmed to enable it to "screen-out" the sounds it has instructed the sound playback IC to play out through a speaker, so that the sounds being played out as a result of identified incoming sound or vibration signals do not add to the extraneous noise levels and thereby make the task of filtering out extraneous noise more difficult for the microprocessor. Techniques for such screening out are well known to practitioners in the field, and they essentially rely upon the fact that since the microprocessor has access to memory files revealing the characteristics of the sounds that may be played out, for example, a police siren, it may either use this information to quickly filter that self-generated noise out, or it may instead be programmed to deactivate its sensors (microphones or the like) precisely when such sounds are being played out by the sound playback IC.

Optionally, the user of the mechanically-generated noise/signal generating item may manually alter the sound or code generated by a particular moving mechanism. This may be achieved, for example, in the case of a toy car by simply changing one or more of the cogs or other suchlike means of mechanically generating sound or vibration, so that instead of causing the electronic device to play out a siren noise, the new cog, which will be provided as a number of alternative cogs, when revolved as a result of moving the car will generate a new code or particular sound pattern which will cause the electronic device to play out a different message.

A series of, for example, cogs bearing different codes may indeed be incorporated within the object, only requiring the user to engage a different cog so that a different sound message, or series of messages, is played out by the electronic device. Such alteration of the code or pattern of sound or vibration which is generated by the movement of the device may be obvious, so that the operator of the item may turn a knob, flick a switch or move a slider to change the sounds generated, or less obvious so that certain sounds will only be played cut under certain circumstances. In a object with several sections, each of which is carrying a different secondary object each section may only generate a particular sound when the secondary object is present. The secondary object may itself cause the different sound or code by interacting with the object.

Alternatively, the electronic device may recognize more than one sound or vibration pattern at a time. It may then play only one sound according to its programming, or it may play out both sound messages, simultaneously.

It should be noted that while references to cogs and the like have been suggested as the means of providing a code, almost any object designed for the purpose may be used. It is, for example, possible to insert a number of different shaped cards into a object which, when elements on-board the object are moved, will cause different sounds to be produced, and, thereby, play different messages.

A plastic toy may have ridges built into the interfacing surfaces between its movable element and the main body of the object so that when the element is moved a series of vibrations or sounds caused by the rubbing of the ridges together may generate a code which causes certain sounds to be played out by a remote unit, for example, when the arm of a doll is raised.

A magnetic means, such as a magnetized ferrite material linked to a movable element on-board the object, and which passes a coil, may also be used to generate a signal or pulse which may be remotely detected and processed. In order to achieve a coded signal identifying, for example, the object in motion, the ferrite material may possess a number of poles which passed the coil to generate such a code.

In the optical case, the ferrite and coil method may, alternatively, generate an electrical pulse to power, for example, an infra-red LED mounted on the exterior of the object. The optical signal will then be detected by an optical sensor mounted on the remote detection device.

The invention includes any method of signal transmission of any energy type, whether R/F, sound, vibration, electromagnetic, or other means. Further, while the playing out of sound messages have been used in many examples in this document as the process which is activated upon the receipt of motion-generated signals, any other type of electrical or electronic device which is thereby caused to be activated is equally possible.

Furthermore, the scope of operations the Key may perform upon receiving and decoding a signal may include the making or breaking of any of one or more electrical circuits associated with the received signal. Thus, the Key might send a signal to another remote item, instructing it to perform certain tasks, or it might by direct electrical means activate any electrical device with which it is in direct electrical contact.

The Key incorporates a means of detecting signals (e.g., a microphone for sound, or a radio receiver for an R/F signal, etc.), and a means of decoding said signals (e.g., a microprocessor and, where appropriate, suitable filtering means to separate said signals from background noise, etc.), and means of activating electrical circuits appropriate to the identity of the item transmitting the signals, or to the content of said transmission, or the circumstances (e.g., time of day, etc.) under which the signals are received or transmitted. For example, a sound message may be played out (or, as another example, one or more lights may be switched on) or the Key may send out a message by any transmission means to a second device, which may then start an electric motor running, etc. In addition, the Key incorporates a power supply.

In this embodiment, the signals transmitted to the Key are generated by mechanical means—or, where electrical power is used to transmit the signals, that that electrical power has been mechanically generated by the device itself.

Additional information, such as object location, may be provided to the Key if multiple microphones or sensors are employed. By comparing the strength or other characteristics of the signals received by one sensor with the other, it will be possible by well-known methods to establish the approximate location or direction of the device of interest if it is generating an identifiable sound or vibration as a result of some movement by that object.

Using such techniques one may, for example, play out sounds from the sound IC when two objects with different ID signatures approached each other.

The ability for Keys to detect other Keys or movement in a object to which it is attached may be accomplished with mechanical, optical, sound, vibration, magnetic, pneumatic, gravity switch, electrical or other means. Such detection may be achieved by, for example, causing Keys to emit a sound signal that other Keys may detect. Alternatively, an optical or electromagnetic signals may be used. Information may be communicated through the object to the Key by wires or conductive ink.

In addition to it potential functions of remotely recognizing signals generated by mechanical means, the remote version of the Key may in alternative embodiments detect changes to a signal where the signal-generating object is designed to be powered by remote means—for example, electromagnetic radiation sufficient to activate integrated circuits on-board the object, and to cause those integrated circuits to relay their data contents to a remote device designed to recognize those relayed signals. If the motion-generated signal means described above is used in such a type of device, movement of one or more movable items on-board, or associated with, said object an cause either a change in the signals relayed to the remote device so that the movement in question may be identified, or alternatively, that the signals generated by the movement of said moveable items on the object are received by the remote device. In either case, the motion-related signals cause the remote device to be able to play out one or more messages appropriate to said movement(s). These messages may be composed from part or the totality of, the data relayed from the IC on-board the object to the remote detection device, where said device is equipped with the means of decoding said data and playing it out through a speaker in the form of sound messages. Alternatively, the remote device may incorporate sound storage and playback facilities to enable it to play messages out related to the motion derived in part or whole from its own on-board sound storage facilities.

A further optional embodiment of the invention is that the signals generated by mechanical means, or powered by mechanical means, may themselves be an encoded form of sound message whether digital or analog to whereby the Key is required only to decode the signal from the object, and to convert it into a sound message. Thus, the Key in this example would not incorporate its own sound storage facility. Such a functionality could, for example, be achieved by the object having on-board a length of magnetic tape, which tape may be read by a tape head or similar sensor, and thereby converted into sound by the normal means used in audio tape decks, for example. Alternatively, the Key, if physically connected to the object, might relay the data to a remote device, which would then convert the data into sound to be played out. Alternatively, the Key could convert the magnetic (in this example) data from analog into digital form, and then relay it to said remote device to be played out.

Further information concerning electronic configurations useable with this invention is shown in the following U.S. Patents: U.S. Pat. Nos. 5,648,753, 5,314,336 and 4,348,191, which are hereby incorporated by reference.

The following examples primarily involve uses for a Key designed for the toy industry. They are merely illustrative of many possible applications for a Key and demonstrate some of the advantages of the invention.

EXAMPLE 1

An object figurine of Captain Hook has a Key hole incorporated into it. When the Key is inserted into Captain Hook's Key hole the Key delivers the message "I'm Captain Hook! Ahoy there, landlubbers!" If the object's arm holding a sword is moved upward the Key delivers the message "Come out and fight, Peter Pan!"

The same Key may be inserted in a Peter Pan object and deliver the message "Where's that devil Hook?". Alternatively, the message may be delivered only if the object is picked up, e.g. "Come on, Wendy! We may fly!" This may be accomplished by incorporating a piezo, or gravity switch, or other movement-sensing device into the Key.

EXAMPLE 2

When a space ship is tilted downwards, the user-recorded message, "Captain, we're going down!" will be played. In this embodiment, either the Key or the object would require motion detector means.

EXAMPLE 3

When a Key is inserted into a teddy bear, the Key may recognize the fact that the object is a teddy bear and may then, by means of a mechanical linkage from the Key to the bear, cause the Bear's arm to move up and down and/or cause the Bear's mouth to open and close. Alternatively, a sound message, preprogrammed or recorded by the user, may be played out to accompany such motions of the arm and/or mouth, and may be played in sync with the motions.

EXAMPLE 4

Rotary movement of an electric motor is transmitted from the Key to the object by mechanical linkage, and is similarly transmitted to one or more elements, for example, via cogs, trains, cams, wires, or similar means. Such rotary movement may be used not only to cause elements on-board the object to move, but may indeed cause the object itself to be moved if the Key's rotary movement is transmitted to, for example, the wheels of a object car. Whilst the rotary power from the Key may simply have an on mode and an off mode, mechanical means may be designed into the object to make it, for example, move forward and then backwards.

EXAMPLE 5

The Key may (a) cause different items on-board the object to move; or (b) cause certain movable items to move only when some switching means is activated by the user. In the first case, if the object allows the user to activate or control different movable elements, the Key may incorporate a number of drive shafts of other independently switchable power transmission means.

EXAMPLE 6

Programmable or programmed Control Means: an IC control chip capable of storing a program may be incorporated within the Key and the Key may then control the object to which the Key is attached in a predetermined way. If the Key contains a number of separately-controllable power transmission means, different movable elements on the object may be separately controlled by such a chip.

EXAMPLE 7

The user may move a teddy bear's arm up and down. the arm is linked to the inserted Key so that when the arm is moved the movement information is conveyed to the Key, and the Key's control electronics may record and store the information, in digital or analogue form, and thereafter repeat the movement when the Key is inserted into that particular object.

EXAMPLE 8

The recorded movements may be associated with sounds. The user may record a speech, for example, to be played out whenever the waving motion of the Bear's arm takes place. Thus, the user may record the Bear waving its arm, and saying "Hallo there!" Such associated recordings of mechanical movement and sound are achieved by recording first one element and then the other, or the memory IC or ICs may be configured so that they simultaneously record the physical movement of the arm and the sound message to be associated with that movement.

EXAMPLE 9

The Key may be inserted into a object—for example, a train with a number of carriages—and there may be, two characters riding on the train. The user may put the Key into record mode, push the object forward, first turning it to the right, stopping for three seconds, reversing it, and then record the message, "Oh, no! We're going backwards!", and then stopping the train and pushing a lever which releases the spring causing one of the riding characters to spring off the train. This entire sequence may be recorded into the Key's memory IC, and later played back.

EXAMPLE 10

The Key may be equipped with sensors which may detect events such as the user releasing the spring and catapulting the character off a toy train at a particular time. Since these events are recordable, they may be repeated by the Key when the user puts the Key in "play" (i.e. repeat) mode. The motor or other drive means on the Key are then instructed by the microprocessor, memory IC or other means, to perform the recorded tasks one by one, or simultaneously.

EXAMPLE 11

The Key may take any physical form. Thus, in the case of a range of object soldiers or perhaps space men, the Key will may the form of a backpack. When it is clipped onto the Captain's back, it may play one message, and when clipped to the radio operator's back, it may play another message.

Alternatively, it may only play a message when the Captain or the radio operator have one of their components moved, or when the objects themselves are moved in a particular way, or when the objects are placed in near other objects incorporating a detectable Key.

EXAMPLE 12

An object containing movable elements such as plastic figurines of Bugs Bunny, and the farmer trying to shoot him, mounted on a platform beneath which is one or more wheels. As the user pushes the object, Bugs Bunny jumps in the air as the farmer fires his gun while yelling. In this example, the Key recognizes the object, detects the movement and plays a sound appropriate to the action.

EXAMPLE 13

A Key containing a gravity switch or piezo could be inserted into a object airplane and programmed to play engine sounds appropriate to the objects angle of ascent or descent.

EXAMPLE 14

The user of the movable items may record into the sound IC sounds it wanted to be played out when specific movable items are moved. For example, when a object soldier raises his arm, thereby generating a code, the user may record "Drop your guns!" Having recorded this sound message in association with the movement with which the user wishes it in future to be associated, every time thereafter that the user raises the soldier's arm, the same message, previously recorded by the user, will be played out.

EXAMPLE 15

A number of pre-recorded sounds may be stored in a sound memory IC, and the user may choose which sound messages, or series thereof, to associate with particular movements of the movable, sound-generating items.

When a user pokes its finger into e doll's tummy it may choose the pre-recorded "gurgling" sound or it may choose the "That hurt!" sound message. Similarly, pulling a object train along may elicit the play of a "Choo-choo!" sound message or that of the engine driver shouting, "Hey! We're going too fast!" If desired, different messages may be programmed by the user to play out in different circumstances. For example, the "going too fast!" message when the train is moving fast, and the "Oh, no! We're going backwards!" sound message when the train is moving backwards.

EXAMPLE 16

When the police car is pushed forward, a siren sound is played. As the racing car is pushed forward, or allowed or instructed to move forward under spring, elastic or its own electric motor power source, the sound of its motor would be played. Alternatively, the pitch of the engine sound may vary to reflect the speed the car is traveling. If the car was brought to a sudden halt, the sound of screeching tires will be played out.

EXAMPLE 17

For example, in pop-up books and the like, it will arguably be attractive to provide a means of playing out appropriate sounds when different items on-board such a book are moved, thereby changing the picture. One reason why such an objective will be expensive is that electrical contacts must run from each movable device on the pages of the book (most probably through the hinge) to the electronics device which will play out the sounds. It will quite probably be cheaper to instead equip the electronic module with the means of identifying which item is being moved (the movable items may cause unique sound or vibration patterns to travel through the book or the air when moved) and thereupon cause the appropriate sound message(s) to be played out without the requirement for electrical connections between the movable devices and the control electronics.

EXAMPLE 18

Light switches may be attached to the any wall or other location anywhere proximate to the lights or other devices they will control. Instead of having to run wires between the switches and the lights, the switches themselves may mechanically generate a unique sound which may be detected by a microphone or other sensor either on-board the light bulb or more likely the light fitting into which the bulb is inserted, or at some other point along the light's electrical supply route. This method enjoys a significant advantage over alternative methods of controlling domestic or other electrical devices, in that no power supply is required at the location where the user operates the mechanically-generated signal generation.

EXAMPLE 19

With reference to FIG. 3, let us say that sensors B and C are safe locations, and sensor A is not a safe location. If Mr. White is placed onto sensor A and no other figurine is present on the platform, he may say:

Oh, no! I'm in big trouble, and no one is here to save me—not even nasty Mr. Black!

If Mr. Black were then placed onto sensor B, Mr. White will say:

Oh, thank goodness! Quick, Mr. Black! Save me! I'm in danger!

Then Mr. Black will say:

"I'm sorry, Mr. White—but frankly, I don't give a damn."

If Mr. Black was then taken off the platform, Mr. Black will call out in surprise, then Mr. White will say:

He's gone—the coward! Come back! Anyway, I'd rather die than be saved by him! Come on, user: quick! Save me yourself.

If the user then lifts up Mr. White, he will say:

Oh, thank you, user! I knew you were my friend!

The example of a possible conversation to be played out through the speaker demonstrates not only that this new capability represents an important step forward from merely playing out sounds in recognition of an item's identity, but further illustrates that the level of interactivity may be enhanced by allowing the user, to interrupt or respond to the speeches, and thereby cause the conversation to take a new route. In the above example, the user responded to Mr. White's appeals for help, and was duly thanked. If the user had not responded, different messages would have been played.

Clearly, many different speeches are possible with this system, which may be randomly selected by the microprocessor from a number of possible options, or may be played out in response to the departure or arrival of a coded object, or based upon the duration of time in a certain status.

Alternatively, with a sound recording & playback chip, it will be possible with the addition of a microphone and associated circuitry to enable the user to record speeches or sounds which will be played out in the circumstances designated by the user, for example, the user may place Mr. White down on his own on a certain sensor, and then record the message, "Where is everyone?!" Thereafter, until a replacement recording is made, that speech will be played out whenever the same circumstances arise.

EXAMPLE 20

A figurine representing character X may be inserted into one of the seats of a object car. When the car is moved, the presence of that character in that location will cause, by the methods described above, an identifying signal to be generated, and the electronic device will play out a particular message. When character Y joined X in the vehicle, different messages may be played out. This provides a means of playing different sounds even where neither the initial item, a object car, or the other item, character X, has any movable parts within them. In combination, however, a particular code or characteristic pat-tern of sound or vibration may be generated to enable the electronic device to ascertain the status of those items and generate a coded or unique sound or vibration.

EXAMPLE 21

Another alternative method is to cause the ID code or unique sound pattern generated by a moving item to be changed when it is located at, or passes by, particular locations.

In the case of a object train or cars moving on a track set, ridges or other unique features will be built in, or added to, the track so that when a vehicle runs over those ridges or location-specific noise or vibration-generating sites, the unique pattern of sound or vibration thereby generated causes the sound IC to play out messages appropriate to those locations. When the object car following the track crossed over railway tracks, for example, the microprocessor, recognizing that that event had taken place, plays a "Ding-Ding-Ding" sound which is generally applicable to a railway crossing. It will alternatively play out a message which is specific to that particular vehicle being present at that particular location, for example, "Car 54, you're going the wrong way—the bank robbers are at the train station!"

While the invention has been described with reference to preferred embodiments, it will be understood by those skilled in the art that various changes may be made and equivalents may be substituted for elements thereof without departing from the scope of the invention. For example, the invention has application in toys as well as in many other applications, and parts for the Key may be interchanged depending on the types of codes and sensing means desired for the particular application. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A device for providing sound and/or movement capabilities to a plurality of objects, which comprises:

an object detection means for detecting an identity of each of the objects and producing an identity signal, the object detection means comprising an object sensor means for sensing an identity code associated with each of the objects;

a movement detection means for detecting a movement by any of the objects and producing a movement signal;

a sound storage means for storing a plurality of sounds associated with each of the objects and the movement;

a sound playback means for receiving the identity signal and/or the movement signal from the object and movement detection means and for accessing and generating a selected sound in the sound storage means responsive to the identity signal and/or the movement signal; and a speaker means for amplifying and audibly emitting the selected sound.

2. A device in accordance with claim 1, wherein the identity signal and the movement signal are produced when the device is in contact with any of the objects.

3. A device in accordance with claim 1, wherein the identity signal and the movement signal are produced when the device is at a location remote to any of the objects.

4. A device in accordance with claim 1, wherein the identity code is of a type selected from the group consisting of mechanical, electrical, infra-red, radio frequency, sound, optical, magnetic, electromagnetic, pneumatic, vibration, capacitive or inductive.

5. A device in accordance with claim 1, wherein the object sensor means is of a type selected from the group consisting of mechanical, electrical, infra-red, radio frequency, sound, optical, magnetic, electro-magnetic, pneumatic, vibration, capacitive or inductive.

6. A device in accordance with claim 1, wherein the identity code is a series of clicks.

7. A device in accordance with claim 1, wherein the identity code is at least one physical deformation or irregularity in a portion of the object which contacts the sensor means.

8. A device for providing sound and/or movement capabilities to a plurality of objects, which comprises:

an object detection means for detecting an identity of each of the objects and producing an identity signal;

a movement detection means for detecting a movement by any of the objects and producing a movement signal, the movement detection means comprising a movement sensor means for sensing a movement code associated with each of the movements;

a sound storage means for storing a plurality of sounds associated with each of the objects and the movement;

a sound playback means for receiving the identity signal and/or the movement signal from the object and movement detection means and for accessing and generating a selected sound in the sound storage means responsive to the identity signal and/or the movement signal; and a speaker means for amplifying and audibly emitting the selected sound.

9. A device in accordance with claim 8, wherein the movement sensor means is of a type selected from the group consisting of mechanical, electrical, infra-red, radio frequency, sound, optical, magnetic, electro-magnetic, pneumatic, vibration, capacitive or inductive.

10. A device in accordance with claim 8, wherein the movement code is of a type selected from the group consisting of mechanical, electrical, infra-red, radio frequency, sound, optical, magnetic, electro-magnetic, pneumatic, vibration, capacitive or inductive.

11. A device in accordance with claim 8, wherein the movement code is a series of clicks.

12. A device in accordance with claim 8, wherein the movement code is movement of a surface having optically identifiable features.

13. A device in accordance with claim 1, wherein the sound storage means comprises a programmable integrated circuit having record and playback features.

14. A device in accordance with claim 13 wherein the playback features may be activated manually.

15. A device in accordance with claim 1, further comprising a motor means for providing a drive force to a movable element on any of the objects.

16. A device in accordance with claim 15, wherein the drive force is generated in response to the identity signal.

17. A device in accordance with claim 15, wherein the drive force is generated in response to the movement signal.

18. A device in accordance with claim 1, wherein the device further comprises means for detecting a secondary object, and is capable of detecting at least. one secondary identity of at least one secondary object and producing at least one secondary identity signal.

19. A device in accordance with claim 18, wherein the secondary identity signal is produced when the object is in contact with at least one secondary object.

20. A device in accordance with claim 8, wherein the sound storage means comprises a programmable integrated circuit having record and playback features.

21. A device in accordance with claim 20, wherein the playback features may be activated manually.

22. A device in accordance with claim 8, further comprising a motor means for providing a drive force to a movable element on any of the objects.

23. A device in accordance with claim 22, wherein the drive force is generated in response to the identity signal.

24. A device in accordance with claim 22, wherein the drive force is generated in response to the movement signal.

25. A device in accordance with claim 8, wherein the device further comprises means for detecting a secondary object, and is capable of detecting at least one secondary identity of at least one secondary object and producing at least one secondary identity signal.

26. A device in accordance with claim 25, wherein the secondary identity signal is produced when the object is in contact with at least one secondary object.

27. A device in accordance with claim 8, wherein the identity signal and the movement signal are produced when the device is in contact with any of the objects.

28. A device in accordance with claim 8, wherein the identity signal and the movement signal are produced when the device is at a location remote to any of the objects.

29. A device for providing sound and/or movement capabilities to a plurality of objects, which comprises:

an object detection means for detecting an identity of each of the objects and producing an identity signal, the object detection means comprising an object sensor means for sensing an identity code associated with each of the objects;

a movement detection means for detecting a movement by any of the objects and producing a movement signal, the movement detection means comprising a movement sensor means for sensing a movement code associated with each of the movements;

a sound storage means for storing a plurality of sounds associated with each of the objects and the movement;

a sound playback means for receiving the identity signal and/or the movement signal from the object and movement detection means and for accessing and generating a selected sound in the sound storage means responsive to the identity signal and/or the movement signal; and a speaker means for amplifying and audibly emitting the selected sound;

wherein the identity signal and the movement signal are produced when the device is at a location remote to any of the objects.

30. A device for providing sound and/or movement capabilities to a plurality of objects, which comprises:

an object detection means for detecting an identity of each of the objects and producing an identity signal;

a movement detection means for detecting a movement by any of the objects and producing a movement signal;

a sound storage means for storing a plurality of sounds associated with each of the objects and the movement;

a sound playback means for receiving the identity signal and/or the movement signal from the object and movement detection means and for accessing and generating a selected sound in the sound storage means responsive to the identity signal and/or the movement signal;

a speaker means for amplifying and audibly emitting the selected sound; and a motor means for providing a drive force to a moveable element on any of the objects, wherein the drive force is generated in response to the identity signal.

31. A device for providing sound and/or movement capabilities to a plurality of objects, which comprises:

an object detection means for detecting an identity of each of the objects and producing an identity signal;

a movement detection means for detecting a movement by any of the objects and producing a movement signal;

a sound storage means for storing a plurality of sounds associated with each of the objects and the movement;

a sound playback means for receiving the identity signal and/or the movement signal from the object and movement detection means and for accessing and generating a selected sound in the sound storage means responsive to the identity signal and/or the movement signal;

a speaker means for amplifying and audibly emitting the selected sound; and a motor means for providing a drive force to a moveable element on any of the objects, wherein the drive force is generated in response to the movement signal.

* * * * *